US006968893B2

(12) United States Patent
Rusby et al.

(10) Patent No.: US 6,968,893 B2
(45) Date of Patent: Nov. 29, 2005

(54) METHOD AND SYSTEM FOR PRODUCTION OF GAS AND WATER FROM A GAS BEARING STRATA DURING DRILLING AND AFTER DRILLING COMPLETION

(75) Inventors: Bruce D. Rusby, Jefferson Hills, PA (US); John K. Wood, Harrison City, PA (US); Stephen J. Kravits, Pleasant Hills, PA (US)

(73) Assignee: Target Drilling Inc., Jefferson Hills, PA (US)

( * ) Notice: Subject to any disclaimer, the term of this patent is extended or adjusted under 35 U.S.C. 154(b) by 0 days.

(21) Appl. No.: 10/406,622

(22) Filed: Apr. 3, 2003

(65) Prior Publication Data

US 2004/0020655 A1 Feb. 5, 2004

Related U.S. Application Data

(60) Provisional application No. 60/369,683, filed on Apr. 3, 2002.

(51) Int. Cl.[7] ..... E21B 7/04
(52) U.S. Cl. ..... 166/50; 166/313; 175/62
(58) Field of Search ..... 166/50, 313; 175/61, 175/62, 69, 70

(56) References Cited

U.S. PATENT DOCUMENTS 6,280,000 B1 8/2001 Zupanick
6,357,523 B1 3/2002 Zupanick (Continued)

OTHER PUBLICATIONS

R.J. "Bob " Stayton, "Horizontal Wells Boost CBM Recovery", Special Report: Horizontal & Directional Drilling, Aug. 2000, (pp. 71, 73–75).

David C. Oyler, et al., "Directional Drilling for Coalbed Degasification, Program Goals and Progress in 1978", RI 8380 Bureau of Mines Report of Investigations/1979, United States Department of the Interior; "Directionally Controlled Drilling to Horizontally Intercept Selected Strata, Upper Freeport Coalbed, Green County, Pa.", RI 8231 Bureau of Mines Report of Investigations/1977, United States Department of the Interior, (11 pgs).

*Primary Examiner*—William Neuder
(74) *Attorney, Agent, or Firm*—The Webb Law Firm

(57) ABSTRACT

A method for producing gas and water during and after drilling from a subterranean coal seam, including the steps of: (a) drilling a main bore intersecting the coal seam, the main bore having an upper substantially vertical portion, a lower substantially horizontal portion or portions, and a curved portion connecting the vertical and horizontal portions; (b) drilling one sumphole drainage bore exiting the curve or horizontal portion of the main bore and extending in the direction at least partially vertically and downwardly with respect to the horizontal portion of the main bore; (c) collecting gas produced from the coal seam through the main bore and branched bores; (d) removing water and effluent from the main bore both during drilling operations and afterwards through the use of parallel casing, whereby a first casing introduces compressed air or gas to the main bore and the annular space between the first and second casing is used for return of the mixture of water, effluent and air or gas to the surface; and (e) enhancing gas production by simultaneously removing effluent and water from the main bore by utilizing gas lifting or dewatering pumps in the drainage bore after drilling completion. The system includes a directional drilling system having a drill mechanism for cutting an object area of the coal seam, and a drill string connected to the drill mechanism to power and control. The system also includes using two casings or one casing and a compressed air tubing to air lift waste material during drilling and a dewatering device(s) installed in the sumphole drainage bore used to dewater the main bore after drilling completion.

23 Claims, 4 Drawing Sheets

U.S. PATENT DOCUMENTS 6,412,556 B1 7/2002 Zupanick
6,425,448 B1 7/2002 Zupanick et al.
6,439,320 B2 8/2002 Zupanick
6,454,000 B1 9/2002 Zupanick
6,478,085 B2 11/2002 Zupanick
6,497,556 B2 12/2002 Zupanick et al.
6,598,686 B1 * 7/2003 Zupanick ..... 175/62
2001/0010432 A1 8/2001 Zupanick
2001/0015574 A1 8/2001 Zupanick
2002/0096336 A1 7/2002 Zupanick et al.
2002/0100616 A1 8/2002 Zupankck et al.
2002/0108746 A1 8/2002 Zupanick et al.
2002/0117297 A1 8/2002 Zupanick et al.
2002/0134546 A1 9/2002 Zupanick
2002/0148613 A1 10/2002 Zupanick
2002/0148647 A1 10/2002 Zupanick
2002/0155003 A1 10/2002 Zupanick et al.
2003/0221836 A1 * 12/2003 Gardes ..... 166/369

* cited by examiner

METHOD AND SYSTEM FOR PRODUCTION OF GAS AND WATER FROM A GAS BEARING STRATA DURING DRILLING AND AFTER DRILLING COMPLETION

This application claims benefit of U.S. Provisional Patent Application No. 60/369,683, filed Apr. 3, 2002, which is incorporated herein by reference.

BACKGROUND OF THE INVENTION

1. Field of the Invention

2. Background of the Invention

Coal is a large energy source. It has been mined from the earth for many years. Deposits of coal beneath the ground surface are positioned in generally horizontal coal seams and include substantial quantities of methane gas entrained in the coal deposits. In underground coal mining, methane gas poses a significant safety risk to the miners. In the past, the methane gas entrained in the coal deposits was simply liberated from the coal, mixed with air in the mine which diluted it to a safe concentration, and the mixture was ventilated to the outside environment. The methane was simply dissipated into the environment and provided no meaningful resource. However, in recent years, this entrained methane gas has been sold commercially as an energy source, typically as a driving source for energy-producing equipment, such as a generator or added to natural gas pipelines.

Utilizing the gas as an energy source requires that the gas be extracted in a concentrated state and captured. Extracting methane from the coal seams in a concentrated state has been achieved by drilling boreholes generally horizontal into the coal seam that extend several thousands of feet.

During and after the methane drilling process, dewatering must occur. Since coal seams have a significant amount of subterranean water associated with them, this water must be drained from the coal seam in order to produce the methane. Further, during the drilling process, water is used at the drilling tip, creating a slurry of drill cuttings, which also must be removed from the borehole. Water and drill cuttings can block the migration of gas through the coal seam to the borehole and therefore must be removed to permit degasification. Additionally, some of the water used in the drilling process can be forced under pressure into the coal seam, further saturating the gas reservoir, which impedes the migration of gas to the borehole. Therefore, dewatering must occur both during the drilling process and after drilling has been completed. Two methods of dewatering during drilling horizontal portions of the borehole in the coal seam are 1) use a combination of concentric casings installed in the vertical and curve portions of the bore in which compressed air would be forced under pressure between the annular space of the casings to air lift the drill effluent or waste to the surface between the annular space of the inner casing and the outside of the drill string, or 2) use one casing and a compressed air tubing run and cemented in the vertical and curve portions of the bore in which compressed air is forced in the tubing to lift the drill effluent to the surface between the annular spacing of the inside of the casing and the outside of the drill string. After drilling in the coal seam is completed, and the drill string is retrieved to the bottom of the curve portion, a rathole or sumphole would be drilled through the coal seam and into the floor below the coal seam to install a dewatering device(s) in the rathole where water and fines will temporarily collect until the dewatering device pumps them to the surface.

Long, generally horizontal boreholes that remain in the coal seam are the most effective manner to extract and capture the gas entrained in the coal seam providing the suitable reservoir and material strength characteristics exist in the coal seam. Horizontal and generally horizontal holes can be effective in a suitable coal seam because they remain in contact with the gas reservoir (the coal bed) for long distances. Typical generally horizontal directional boreholes are drilled from inside the coalmine, which create several safety concerns, require the use of specialized equipment, and usually have limited borehole productive life. Transportation of gas in a pipeline, inside an underground coalmine, requires considerable maintenance and safety inspections due to the explosive nature of gas. Although directionally drilled inseam holes can reach several thousand feet, the holes do not always provide complete degasification before the coal seam is mined. Oftentimes the coal mining operator must mine the coal in an area before complete degasification has been achieved. Therefore, a method to maximize coal bed gas recovery while reducing the safety risks to the coal operators is desirable. Furthermore, in areas not associated with current or future coal mining, the dewatering methods described herein, both during and after drilling will maximize coal seam methane recovery.

Long, generally horizontal boreholes drilled from inside the coalmine are relatively easy to dewater due to the ability of the gas to purge water from the borehole because the boreholes are generally level with the end of the borehole, therefore, the gas does not have to overcome substantial hydraulic head to purge the water from the borehole.

It is an object of the present invention to overcome the deficiencies inherent in the prior art. It is another object of the present invention to provide a method for producing gas from a coal seam yielding increased operator safety. It is another object of the present invention to provide a method for producing gas from a coal seam while simultaneously producing in-situ water, water induced in the coal seam while drilling by the drill mechanism and drill cuttings during the directional drilling operation. It is yet another object of the present invention to provide a method of simultaneously producing gas and water from a coal seam after drilling is complete to allow increased gas exploitation of a coalfield.

SUMMARY OF THE INVENTION

Accordingly, the present invention is directed to a method for producing gas, water and drilling effluent from a subterranean coal seam, both during and after drilling completion, including the steps of: (a) drilling a main bore intersecting the coal seam, the main bore having an upper substantially vertical portion, a lower substantially horizontal portion or portions, and a curved portion connecting the vertical and horizontal portions; (b) after all branches in the coal seam have been drilled, drilling one drainage bore, called a rathole or sumphole, exiting the horizontal portion of the main bore and extending in a direction at least partially vertical and downward with respect to the horizontal portion of the main bore; and (c) collecting gas produced from the coal seam through the main bore and branched bores in the coal seam. The present invention includes dewatering methods that permit dewatering to be performed both during drilling and after drilling completion, while simultaneously producing gas.

The present invention is also directed to a system for producing gas, water and drilling effluent from a subterranean coal seam. This system includes a directional drilling system, which includes a drill mechanism for cutting an object area of the coal seam, and a drill string connected to the drill mechanism to power and control it. A main bore intersects the coal seam, and the main bore has an upper substantially vertical portion, a lower substantially horizontal portion or portions and a curved portion connecting the vertical and horizontal portions. During drilling operations, the system includes using either two concentric casings or one casing and a compressed air tubing, to transport compressed air to the curve portion of the bore to air lift drill effluent to assist dewatering of the bore. After all branches in the coal seam are completed, the system also includes directionally drilling one drainage bore, or rathole or sumphole, within the curved portion or at the bottom of the curved portion where it intersects the horizontal portion or from within the horizontal portion below the curve portion, whereby it exits the horizontal portion of the main bore and extends in a direction at least partially vertically and downwardly with respect to the horizontal portion of the main bore. This drainage bore is configured to permit the installation of a dewatering device or devices to pump subterranean water, drill effluent consisting of drill water and residual drill cuttings or fines that are temporarily collected in the rathole after drilling is completed.

The present invention, both as to its construction and its method of operation, together with additional objects and advantages thereof, will best be understood from the following description of specific embodiments when read in connection with the accompanying drawings.

DESCRIPTION OF THE PREFERRED EMBODIMENTS

Figure 1:
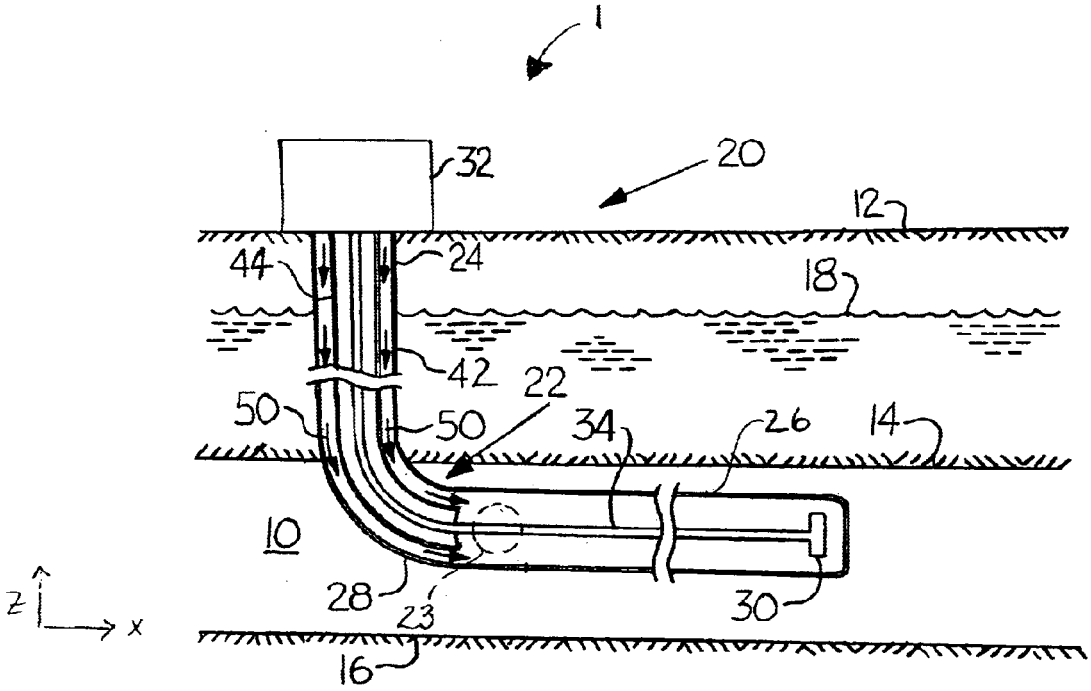
FIG. 1 is a side schematic view of a system for producing gas and water from a coal seam during directional drilling according to the present invention.

A complete understanding of the invention will be obtained from the following description when taken in connection with the accompanying drawing figures, wherein like reference characters identify like parts throughout.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As shown in FIG. 1, the present invention is a system for drilling and producing gas, typically methane, water and drilling effluent from a subterraneous coal seam 10, both during directional drilling and after drilling is complete. Such a coal seam 10 is located below the earth's surface 12 and extends substantially horizontally and parallel with the surface 12. For example, a coal seam 10 may lie 1,000 to 2,000 feet below the surface 12 and have a thickness of a few feet to fifty (50) feet. The thickness of the coal seam 10 is defined by the strata above (roof 14) and the strata below (floor 16). Also, there is typically a ground water layer 18 or aquifer positioned between the surface 12 and the roof 14. At times, this ground water layer 18 can act as the source of water entrained in the coal seam 10.

In order to extract methane gas from the coal seam 10, the present invention uses a directional drilling method. To access an object area of the coal seam 10, from which gas is to be collected, the system includes a directional drilling system 20, located on the surface 12. The main bore 22 includes an upper substantially vertical portion 24, a lower substantially horizontal portion 26 and a curved portion 28 connecting the vertical portion 24 and the horizontal portion 26.

The vertical portion 24 of the main bore 22 begins at the surface 12 and extends to a point approximately 150–1000 feet above the coal seam. The curved portion 28 of the main bore 22 begins approximately 150–1000 feet above the coal seam and extends through the coal seam roof 14 and into the coal seam 10. Finally, the horizontal portion 26 of the main bore 22 extends in or adjacent to the coal seam 10.

The main bore 22 is typically an annular conduit created by directional drilling, which is large enough to allow passage of a drill mechanism 30 and drill effluent therethrough. The directional drilling system 20 includes a directional drilling station 32 for operating and steering or controlling the direction the drill mechanism 30 drills. Any directional drilling system, which is known in the art, may be used. The directional drilling station 32 is connected to the drill mechanism 30 by a drill string 34, which acts to power and control the drill mechanism 30. Water or a combination of water and air injected through the drill string 34 powers the cutting mechanism 30 and provides other operational benefits. For example, injected water assists in cooling the borehole positional surveying tools that are part of the drill string 34, and also mixes with the drill cuttings to create slurry that carries the cuttings away from the drill mechanism 30. These two flows, the entrained ground water combined with the drill water and cuttings become drilling effluent, or waste material 38.

Figure 2:
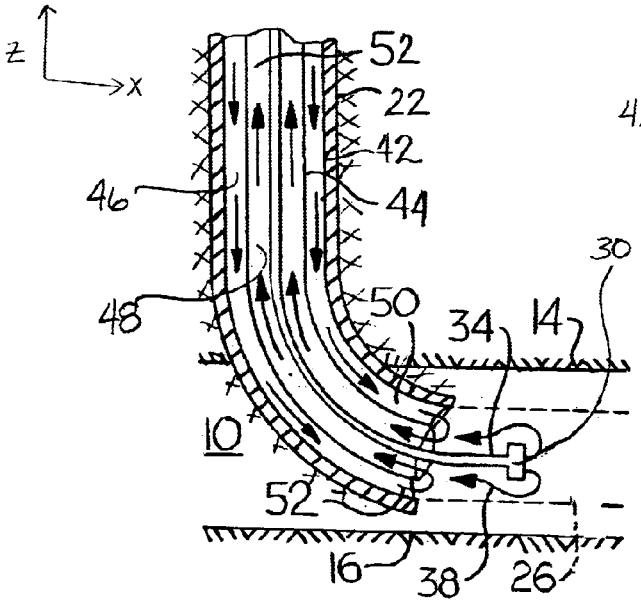
FIGS. 2 and 3 are side schematic views of a second and third embodiment of a system for producing gas and water from a coal seam during drilling according to the present invention.
Figure 3:
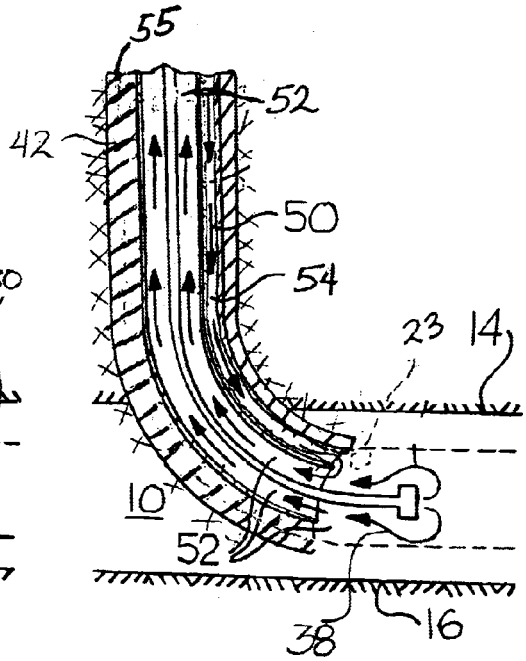
Figure 3A:
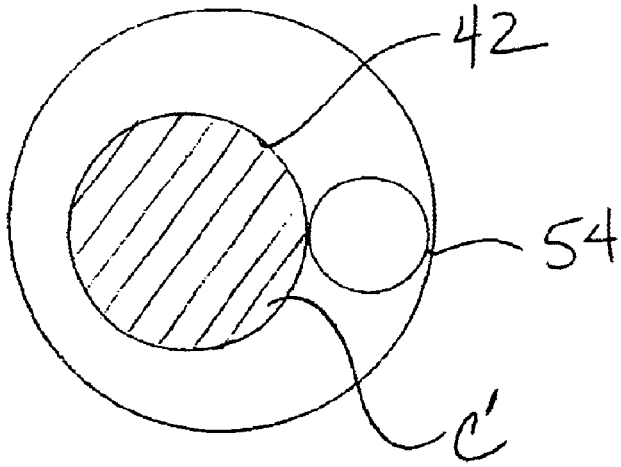
Figure 3B:
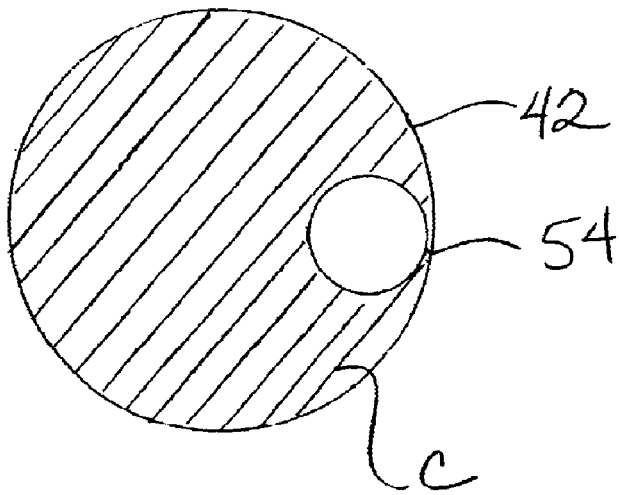
Figure 4:
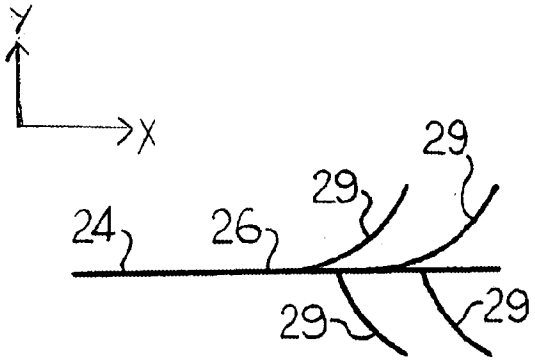
FIGS. 4 and 5 are plan schematic views of the fourth embodiment of the system for producing gas and water from a coal seam according to the present invention.

The waste material 38 must be removed during drilling operations. In order to assist in the removal, a second embodiment of the present invention are illustrated in FIG. 2 and FIG. 3. First casing 44 or outer most casing and second casing 45 or inner most casing are installed, concentrically or side-by-side, in the vertical portion 24 and curved portion 28 of the main bore and terminate near the end of the curved portion 28 where the horizontal portion 26 begins. Installation of the first casing can also be terminated at the beginning of the curve portion. The first casing 44 is sufficiently sized to permit passage of the first casing 45. The second casing 45 is sufficiently sized to permit passage of the drill string 34 inside it while allowing the waste material 38 to pass by the annular space created by the outside of the drill string 34 and the inside of the second casing 45. Compressed air or gas 50 is introduced into the annular space between the first casing 44 and the second casing 45 at the surface 12, exits the annular space of the two casings 44 and 45 at or near the end of the curved portion 28 of the borehole, and mixes with the waste material 38, where it assists lifting the waste material to the surface between the annular space of the drill string and the inner casing 45. As an alternative to using two concentric casings to dewater during drilling, FIG. 4 illustrates the use of one casing and a compressed air tubing run and cemented in the vertical and curve portions of the bore in which compressed air is forced in the tubing to lift the drill effluent to the surface between the annular spacing of the inside of the casing and the outside of the drill string. Adding air or gas 50 to the drill effluent changes its specific gravity and the resulting mixture is lighter than drill effluent alone. This lighter mixture of drill effluent and compressed air 52 is forced under pressure up through the annular space between the inside of the second casing and the outside of the drill string and exits at the surface. In this manner, waste material 38 is removed from the hole during drilling operations. Additionally, after drilling operations are complete and the drill string is removed, this method can be used for long term dewatering by utilizing some of the gas produced from the coal seam. The gas would be compressed at the surface, and pumped down the inside of the second casing 45 to mix with the water and gas produced from the horizontal portion of the main bore and lift the water out of the curved portion 28 and the vertical portion 24 of the main bore 22 through the annular space between the inside of the first casing and the outside of the second casing.

Figure 6:
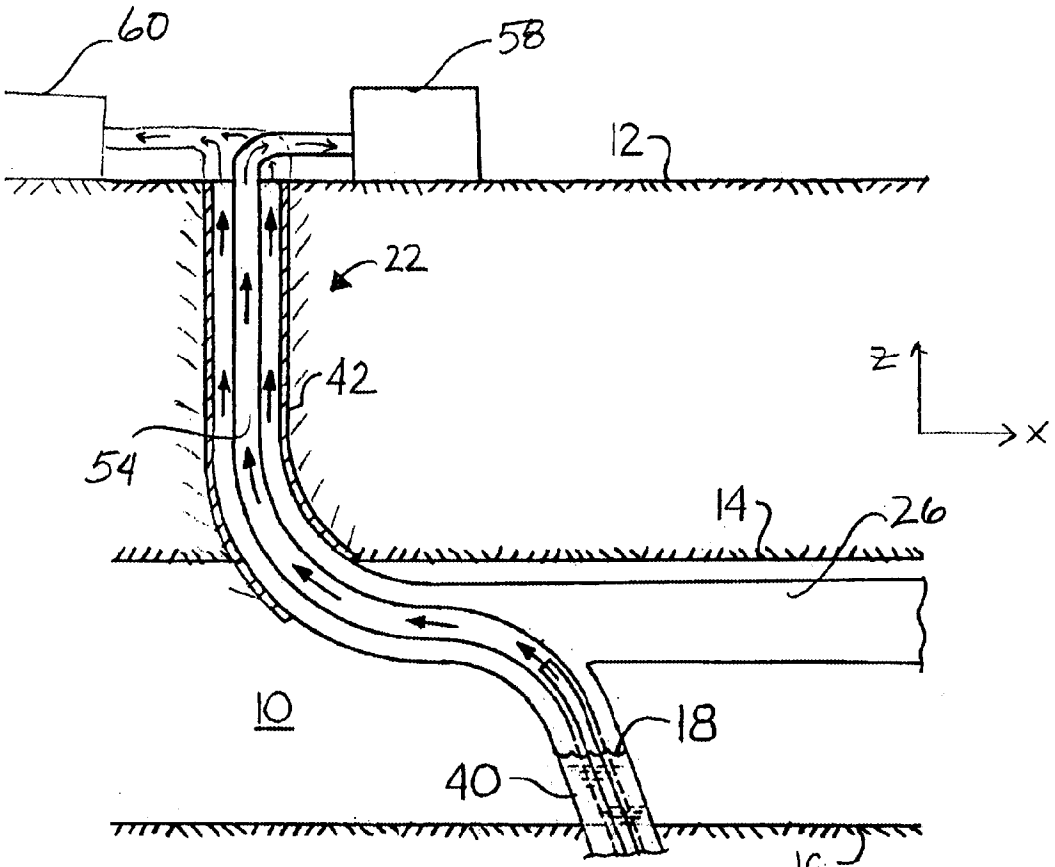
FIG. 6. is a side view schematic view of a system for producing gas and water and residual coal cuttings from a coal seam after directional drilling completion according to the present invention.
Figure 7:
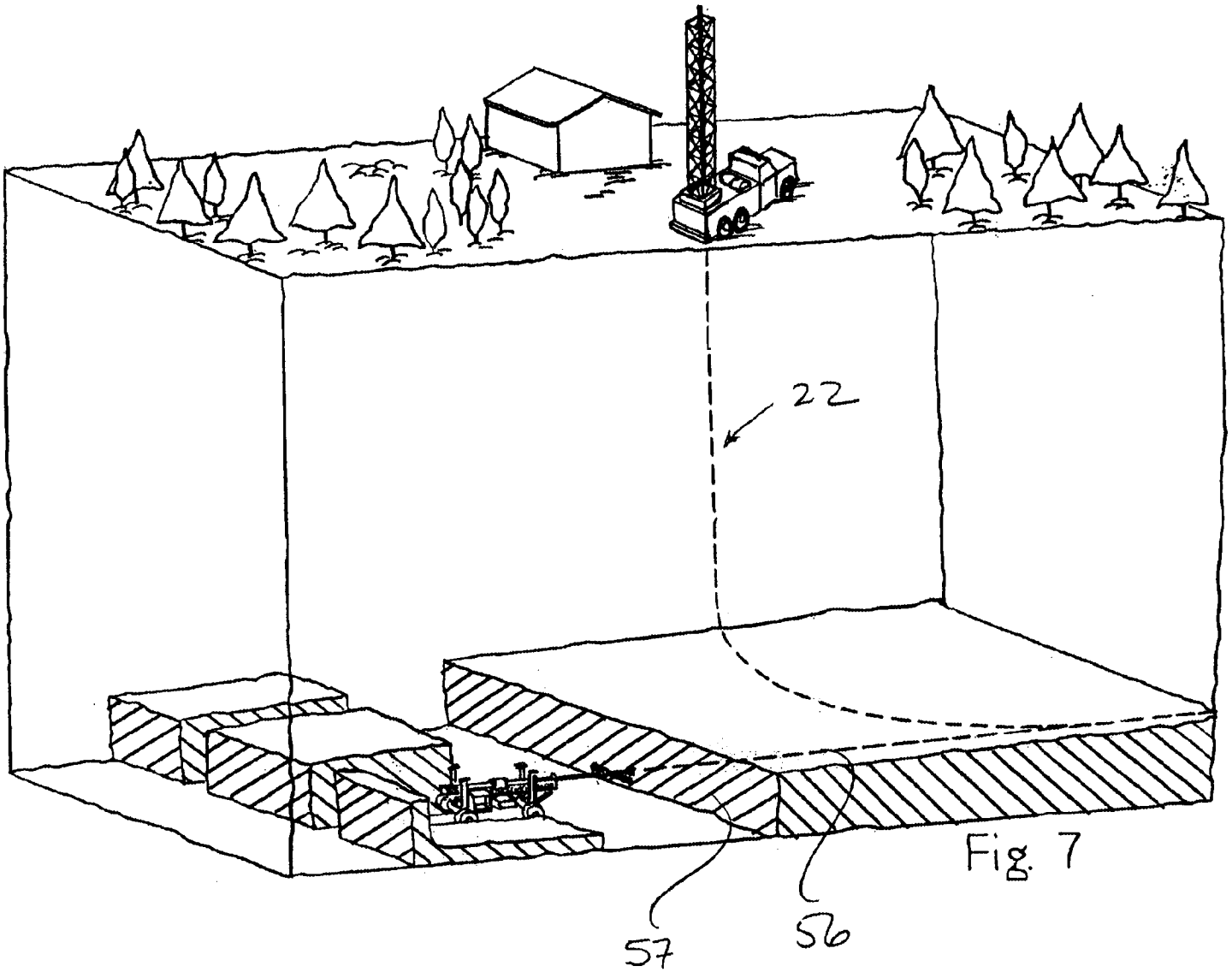

After directional drilling of the horizontal portion 26 is completed entirely, a rathole or sumphole drainage bore 40 can be directionally drilled either from the curve portion 28 or from the horizontal portion 26 near the curve at least partially vertically and downwardly with respect to the horizontal portion 26 and below the horizontal portion to facilitate the installation of a dewatering device where waste material is temporarily collected until pumped to the surface shown by FIG. 6. It is this partially vertical and downward orientation of the sumphole drainage bore 40 that allows for the installation of a dewatering device(s) where the temporary collection and storage of the effluent 52 or waste material 38, occurs.

Figure 5:
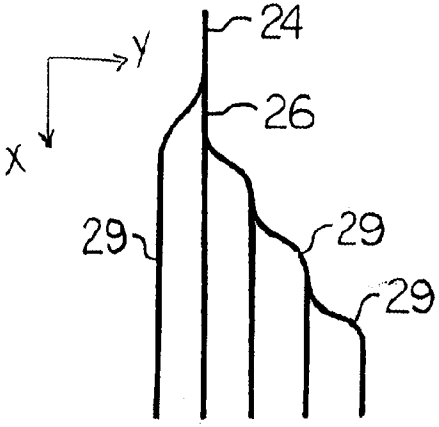

Another embodiment of the present invention is illustrated in FIGS. 4 and 5. The use of the directional drilling system 20 allows much greater gas exploitation and geologic exploration of the coal seam 10. The only limitation to the horizontal length of the horizontal portion 26 of the main bore 22 is the length of the drill string 34, with the drill mechanism 30 attached and associated directional drilling capabilities. Additionally, generally horizontal branched bores 29 can be drilled from the main bore 22 that extend obliquely to the axis of the main bore 22. The horizontal portion of the main bore 22 and the branched bores 29 can be configured in a variety of patterns to maximize the gas production. The quantity, orientation and configuration of the branched bores 29 depend on several factors and are very site specific. It is envisioned that the horizontal portion 26 of the main bore 22, and the branched bores 29 can extend as long as required to allow maximum gas exploitation of the coal seam 10.

The main bore 22 preferably is drilled using a combination of drilling techniques and apparatus that is well known to those skilled in the art. It is also envisioned that a portion of the main bore 22, typically the vertical portion 24 and at least a part of the curved portion 28, uses a casing layer 42 to protect the main bore 22 from direct water infiltration from the ground water layer 18.

The present invention is also directed to a method for producing gas, typically methane, drill effluent (water and cuttings) during drilling and water and residual coal cuttings after drilling is completed, from a subterranean coal seam 10. The method includes the steps of: (a) drilling a main bore intersecting the coal seam, the main bore having an upper substantially vertical portion, a lower substantially horizontal portion or portions and a curved portion connecting the vertical portion and the horizontal portion; (b) after the horizontal portions are completed, drilling one drainage sumphole exiting the horizontal portion of the main bore and extending in the direction at least partially vertically and downwardly with respect to the horizontal portion of the main bore; and (c) collecting gas produced from the coal seam through the main bore and branched bores by either injecting compressed gas inside the second casing and flowing gas and water through the annular space between the first and second casing or by installing a dewatering device(s) in the sumphole. This method uses directional drilling techniques to extract methane and water from the coal seam during and after drilling without requiring an excessive amount of subterranean equipment.

The method and system of the present invention provide a directional drilling and dewatering systems for producing gas and water during and after drilling completion from a subterranean coal seam and allow for a safer operating environment. In addition, the method and system of the present invention allow for an increased efficiency in drilling operations, and provide maximum coal seam exploitation and exploration.

This invention has been described with reference to the preferred embodiments. Obvious modifications and alterations will occur to others upon reading and understanding the preceding detailed description. It is intended that the invention be construed as including such modifications and alterations.

What is claimed is:

1. A system for producing gas and water from a gas bearing strata both during drilling and after drilling completion, the system comprising:

(a) a directional drilling system, comprising:

(i) a drill for drilling or cutting an object area of the gas bearing strata and (ii) a drill string connected to the drill and configured to power and control the drill;

(b) a main bore intersecting the gas bearing strata, the main bore having an upper vertical portion, a lower horizontal portion and a curve portion connecting the vertical portion and the horizontal portion;

(c) a pump installed in the main bore to pump waste material to the surface; and (d) a drainage sumphole bore exiting the horizontal portion of the main bore and extending in a direction at least partially inclined downwardly with respect to the horizontal portion of the main bore.

2. The system according to claim 1, whereby the drainage sumphole bore is configured to facilitate the installation of a second pump where waste material collects temporarily after drilling completion until pumped to the surface by the second pump installed in the sumphole.

3. The system according to claim 1, further including branched bores extending from the horizontal portion of the main bore.

4. The system according to claim 1, wherein the drainage sumphole bore exits the curve portion of the main bore.

5. A system for producing gas and water from a gas bearing strata both during drilling and after drilling completion, the system comprising:

(a) a directional drilling system, comprising:

(i) a drill for drilling or cutting an object area of the gas bearing strata and (ii) a drill string connected to the drill and configured to power and control the drill;

(b) a main bore intersecting the gas bearing strata, the main bore having an upper vertical portion, a lower horizontal portion and a curve portion connecting the vertical portion and the horizontal portion; and (c) a pump installed in the main bore to pump waste material to the surface, wherein the vertical portion and the curve portion of the main bore further comprises an outer casing and an inner casing.

6. The system according to claim 5, wherein the outer casing and the inner casing extend into the curve portion of the main bore.

7. The system according to claim 5, wherein the drill string is located within the inner casing.

8. The system according to claim 7, wherein compressed gas is pumped through an annular space between the outer casing and the inner casing and a mixture of the compressed gas and waste material is removed through an annular space between the inner casing and the drill string.

9. The system according to claim 8, wherein a drainage sumphole bore exits the curve portion of the main bore after drilling completion of the horizontal portion of the main bore.

10. A system for producing gas and water from a gas bearing strata both during drilling and after drilling completion, the system comprising:

(a) a directional drilling system, comprising:

(i) a drill for drilling or cutting an object area of the gas bearing strata and (ii) a drill string connected to the drill and configured to power and control the drill;

(b) a main bore intersecting the gas bearing strata, the main bore having an upper vertical portion, a lower horizontal portion and a curve portion connecting the vertical portion and the horizontal portion; and (c) a pump installed in the main bore to pump waste material to the surface, wherein the main bore further comprises a casing and a compressed gas tubing fixed in the vertical portion of the main bore.

11. The system according to claim 10, wherein the casing and the compressed gas tubing are fixed in the vertical and curve portion of the main bore.

12. The system according to claim 11, wherein compressed gas is pumped through the tubing and a mixture of the compressed gas and waste material is removed through an annular space between the casing and the drill string located within the casing.

13. A method for producing gas and water from a gas bearing strata both during drilling and after drilling completion, comprising the steps of:

(a) drilling a main bore intersecting the strata, the main bore having an upper vertical portion, a lower horizontal portion or portions and a curve portion connecting the vertical portion and the horizontal portion;

(b) fixing a first conduit to a top of the vertical portion;

(c) removing water and drilling effluent from the main bore during drilling operations;

(d) passing a recovery gas through the first conduit, wherein the recovery gas is produced from the strata through the main bore;

(e) collecting the recovery gas, further including an internal conduit and an external conduit, wherein the internal conduit diameter is less than the external conduit diameter and the area between the external conduit and the internal conduit is capped so that recovery gas passes through the internal conduit.

14. A method for producing gas and water from a gas bearing strata both during drilling and after drilling completion, comprising the steps of:

(a) drilling a main bore intersecting the strata, the main bore having an upper vertical portion, a lower horizontal portion or portions and a curve portion connecting the vertical portion and the horizontal portion;

(b) fixing a first conduit to a top of the vertical portion;

(c) removing water and drilling effluent from the main bore during drilling operations;

(d) passing a recovery gas through the first conduit, wherein the recovery gas is produced from the strata through the main bore;

(e) collecting the recovery gas; and (f) installing a pump at a distal end of the curve portion of the main bore to remove water and drill effluent.

15. The method according to claim 14, wherein collecting recovery gas occurs through a plurality of boreholes.

16. A method for producing gas and water from a gas bearing strata both during drilling and after drilling completion, comprising the steps of:

(a) drilling a main bore intersecting the strata, the main bore having an upper vertical portion, a lower horizontal portion or portions and a curve portion connecting the vertical portion and the horizontal portion;

(b) fixing a first conduit to a top of the vertical portion;

(c) removing water and drilling effluent from the main bore during drilling operations;

(d) passing a recovery gas through the first conduit, wherein the recovery gas is produced from the strata through the main bore;

(e) collecting the recovery gas; and (f) drilling a drainage sumphole bore exiting the horizontal portion of the main bore and extending in a direction at least partially inclined downwardly with respect to the horizontal portion of the main bore, after drilling completion of the horizontal portion of the main bore.

17. The method according to claim 16, further including the step of installing a pump in the drainage sumphole bore where water temporarily collects until it is pumped to the surface by the pump.

18. The method according to claim 16, further including the step of drilling an in-mine horizontal borehole at a horizontal incline intersecting the horizontal portion of the main bore, whereby water and drill effluent removal occurs within the in-mine horizontal borehole and gas produced from the horizontal portion is collected through the vertical portion of the main bore.

19. A method for producing gas and water from a gas bearing strata both during drilling and after drilling completion, comprising the steps of:

(a) drilling a main bore intersecting the strata, the main bore having an upper vertical portion, a lower horizontal portion or portions and a curve portion connecting the vertical portion and the horizontal portion;

(b) fixing a first conduit to a top of the vertical portion;

(c) removing water and drilling effluent from the main bore during drilling operations;

(d) passing a recovery gas through the first conduit, wherein the recovery gas is produced from the strata through the main bore;

(e) collecting the recovery gas, wherein the step of fixing the conduit includes an inner conduit and an outer conduit.

20. A method for producing gas and water from a gas bearing strata both during drilling and after drilling completion, comprising the steps of:

(a) drilling a main bore intersecting the strata, the main bore having an upper vertical portion, a lower horizontal portion or portions and a curve portion connecting the vertical portion and the horizontal portion;

(b) fixing a first conduit to a top of the vertical portion;

(c) removing water and drilling effluent from the main bore during drilling operations;

(d) passing a recovery gas through the first conduit, wherein the recovery gas is produced from the strata through the main bore;

(e) collecting the recovery gas, wherein a drill string is located within the conduit and further removing water and drill effluent by pumping compressed gas through an annular space between the outer conduit and the inner conduit and removing a mixture of the compressed gas and waste material through an annular space between the inner conduit and the drill string during drilling.

21. A method for producing gas and water from a gas bearing strata both during drilling and after drilling completion, comprising the steps of:

(a) drilling a main bore intersecting the strata, the main bore having an upper vertical portion, a lower horizontal portion or portions and a curve portion connecting the vertical portion and the horizontal portion;

(b) fixing a first conduit to a top of the vertical portion;

(c) removing water and drilling effluent from the main bore during drilling operations;

(d) passing a recovery gas through the first conduit, wherein the recovery gas is produced from the strata through the main bore;

(e) collecting the recovery gas, wherein passing of a compressed gas after drilling completion is through the conduit and a mixture of compressed gas and waste material is forced up through tubing located adjacent the conduit.

22. A method for producing gas and water from a gas bearing strata both during drilling and after drilling completion, comprising the steps of:

(a) drilling a main bore intersecting the strata, the main bore having an upper vertical portion, a lower horizontal portion or portions and a curve portion connecting the vertical portion and the horizontal portion;

(b) fixing a first conduit to a top of the vertical portion;

(c) removing water and drilling effluent from the main bore during drilling operations;

(d) passing a recovery gas through the first conduit, wherein the recovery gas is produced from the strata through the main bore;

(e) collecting the recovery gas, further including a tubing wherein the internal diameter of the tubing is less than the external diameter of the conduit and the area between the conduit and the tubing is capped so that recovery gas passes through the tubing up to the surface.

23. A method for producing gas and water from a gas bearing strata both during drilling and after drilling completion, comprising the steps of:

(a) drilling a main bore intersecting the strata, the main bore having an upper vertical portion, a lower horizontal portion or portions and a curve portion connecting the vertical portion and the horizontal portion;

(b) fixing a first conduit to a top of the vertical portion;

(c) removing water and drilling effluent from the main bore during drilling operations;

(d) passing a recovery gas through the first conduit, wherein the recovery gas is produced from the strata through the main bore;

(e) collecting the recovery gas, further including tubing wherein the internal diameter of the tubing is less than the external diameter of the conduit and the tubing is positioned in the bore adjacent to and external of the conduit, wherein the conduit is capped so that recovery gas passes through the tubing up to the surface.

* * * * *

UNITED STATES PATENT AND TRADEMARK OFFICE

CERTIFICATE OF CORRECTION

PATENT NO. : 6,968,893 B2
DATED : November 29, 2005
INVENTOR(S) : Rusby et al.

It is certified that error appears in the above-identified patent and that said Letters Patent is hereby corrected as shown below:

Title page,
Item [75], Inventors, should read:
-- Stephen J. Kravits, Pleasant Hills, PA (US); Bruce D. Rusby, Jefferson Hills, PA (US); John K. Wood, Harrison City, PA (US) --.
Item [57], ABSTRACT, should read:
-- A system for producing gas and water from a gas bearing strata during and after drilling completion. The system includes a directional drilling system, a main bore and pump. The directional drilling system includes a drill and a drill string. The main bore intersects the gas bearing strata and has an upper vertical portion, a lower horizontal portion and a curve portion connecting the vertical portion and the horizontal portion. Waste material collects temporarily until pumped to the surface by the pump installed in the bore. --.

Signed and Sealed this

Thirtieth Day of May, 2006

JON W. DUDAS
*Director of the United States Patent and Trademark Office*